US005404775A

United States Patent [19]

Abe

[11] Patent Number: 5,404,775

[45] Date of Patent: Apr. 11, 1995

[54] RIGHT ANGLE FASTENING DEVICE

[75] Inventor: Tetsuo Abe, Aichi, Japan

[73] Assignee: Sanyo Machine, Rochester, Mich.

[21] Appl. No.: 212,559

[22] Filed: Mar. 11, 1994

[51] Int. Cl.[6] ..... B25B 23/151

[52] U.S. Cl. ..... 81/469; 81/57.13; 81/467; 73/862.21

[58] Field of Search ..... 81/57.13, 57.29, 467, 81/469; 173/12; 73/862.21, 862.23, 862.35

[56] References Cited

U.S. PATENT DOCUMENTS

| | | | |
|---|---|---|---|
| 4,084,429 | 4/1978 | Boland | 81/57.13 X |
| 5,014,794 | 5/1991 | Hansson | 81/469 X |
| 5,115,701 | 5/1992 | Lehnert | 81/469 X |

FOREIGN PATENT DOCUMENTS

| | | | |
|---|---|---|---|
| 3529992 | 2/1987 | Germany | 81/57.13 |

*Primary Examiner*—James G. Smith
*Attorney, Agent, or Firm*—Weintraub, DuRoss & Brady

[57] ABSTRACT

A nut runner for applying torque to a workpiece such as nut, bolt or the like positioned at a right-angle to the fastening device. The nut runner includes a motor, a speed reduction gear assembly, a right-angle bevel gear system, a planetary gear system, an in-line torque transducer disposed between the bevel gear system and the planetary gear system, a torque reading transmitter, and a workpiece engaging member. The bevel gear system, planetary gear system and torque transducer form a concentrated assembly which provides for a compact nut runner to access confined assembly areas. The motor causes the engaging member to rotate. The torque transducer senses the torque and the torque reading transmitter sends the reading to an operator or controller which interrupts the power supply to the nut runner when a predetermined torque is reached.

9 Claims, 2 Drawing Sheets

RIGHT ANGLE FASTENING DEVICE

FIELD OF THE INVENTION

The present invention pertains to nut-runners. More particularly, the present invention concerns right angle nut-runners. Even more particularly, the present invention concerns right angle nut runners which both apply torque to a workpiece at a right angle and measures the applied torque thereto.

THE PRIOR ART

Nut runners, which apply a measured torque to tighten nuts, bolts and other fasteners, are well known. They permit a nut, bolt or other like rotatable fastener to be tightened to a desired assembly standard. This precision of fastening substantially improves upon the quality of the assembled product. As is also known to the skilled artisan the nut runner can be fitted with an indicating device which provides the operator with a reading of the amount of torque being applied to the workpiece.

However, during the assembly process, fasteners are often positioned in such a manner as to require the nut runner to apply rotational force to the fastener at a right angle to the body. The nut runner requires the nut runner to have the nut runner to have a device or workpiece engaging member positioned normal or perpendicular to the body thereof. Such nut runners are commonly known as "right-angle nut runners".

Typically, such right-angle nut runners include a housing having a motor, a gear reducer, and a right angle gear assembly disposed therein. A rotating spindle operatively connected to the right-angle gear assembly extends therefrom normal to the body. A workpiece engaging member is mounted on the free end of the spindle. In use, the motor and the spindle are used to apply a torque to a fastener to cause the fastener to start to rotate. Furthermore, such prior art right-angle nut runners include means for measuring the torque which is being applied to the fastener by the nut runner. Usually, a torque transducer, located immediate the motor and the gear reducer, is employed to measure the torque applied by the engaging member to the workpiece.

Two approaches are common in the prior art to measure the applied torque to a workpiece so positoned to require a right angle nut runner. One approach, as noted, places the torque transducer between the speed reducer and the gear approach. This assembly measures the torque at the speed reducer and not the torque at or near the workpiece. The torque at the two locations will be different, as there is a dramatic torque loss in the right-angle gear assembly due to function amd other factors.

A second approach places the torque transducer between the right-angle gear assembly and the engaging member. This provides a more accurate reading of the actual torque being applied at or near the workpiece. However, placing the torque transducer at this location greatly increases the size of the right-angle assembly. This severely restricts the use of the nut runner to assembly areas which can accomodate nut runners of this size.

The problems associated with any of these consequences are readily apparent.

Thus, a major advance in the art would be provided by a compact right-angle nut runner which reads the actual torque applied to the workpiece or fastener being tightened. As is subsequently detailed, the present invention achieves this.

SUMMARY OF THE INVENTION

In accordance with the present invention, there is provided a fastening device or nut runner for applying and measuring the torque applied to a workpiece positioned at a right-angle to the body of the nut runner. The nut runner hereof, generally, comprises:

(a) a body;

(b) means for rotating a workpiece disposed in the body, the means for rotating including a first shaft extending therefrom;

(c) a right-angle gear system, the gear system operatively connected to the first shaft of the means for rotating, the gear system comprising:

(1) a first gear disposed with and removably attached to the first shaft;

(2) a second gear disposed normal to and meshingly engaging the first gear;

(3) a second shaft, the second shaft being disposed coaxially with the second gear and normal to the first shaft, the second shaft having a first end and a second end, the shaft being removably connected to the second gear proximate the first end, the shaft having a plurality of gear teeth formed thereon proximate the second end;

(4) a planetary gear system, the planetary gear system connected to the second shaft, the planetary gear system cooperatively meshing with the gear teeth of the secondary shaft, the planetary gear system having a third shaft in-line with the second shaft and normal to the first shaft;

(d) means for sensing the torque being applied the workpiece, the means for sensing disposed proximate the second end of the second shaft immediate the second gear, the means for sensing surrounding the planetary gear system;

(e) a housing surrounding the right-angle gear system, the means for sensing and the planetary gear system; and (f) a workpiece engaging member, the engaging member removably attached to the third rotary shaft.

The workpiece engaging member hereof applies torque to a workpiece or fastener, such as a nut, bolt or the like. The nut runner tightens the workpiece to a predetermined torque. This is detected by the means for sensing, which then stops the rotation of the nut runner.

The means for rotating, generally, comprises a motor having a power shaft which extends to the reduction gear assembly or speed reducer which has the first output shaft extending therefrom. The first shaft extends to the right-angle gear system. The right-angle gear system has a second output shaft positioned at a right-angle to the first shaft of the gear reduction assembly and extending to the planetary gear system. That portion of the second shaft of the gear system extending to the planetary gear system has a plurality of gear teeth formed thereon which engage the planetary gear system. The planetary gear system has a third output shaft extending therefrom which rotates the workpiece engaging member which, in turn, rotatably engages a workpiece such as a bolt, nut or the like.

The means for sensing the torque, generally, comprises a torque transducer. The torque transducer is disposed in-line between the right-angle gear system and the planetary gear system. Specifically, the torque transducer is positioned around the planetary gear system with the second shaft of the right-angle gear system inserted therethrough.

Means for signalling may be associated with the means for sensing and to emit a signal to indicate that the applied torque to the workpiece has reached its predetermined value. This means for signalling may include control means which causes the means for rotating to stop rotating, thereby, discontinuing to apply torque to the workpiece when the predetermined value is achieved.

For a more complete understanding of the present invention, reference is made to the following detailed description and accompanying drawings. In the drawing, like reference elements refer to like characters throughout the several views and descriptions, in which:

DETAILED DESCRIPTION OF THE PREFERRED EMBODIMENT

Figure 1:
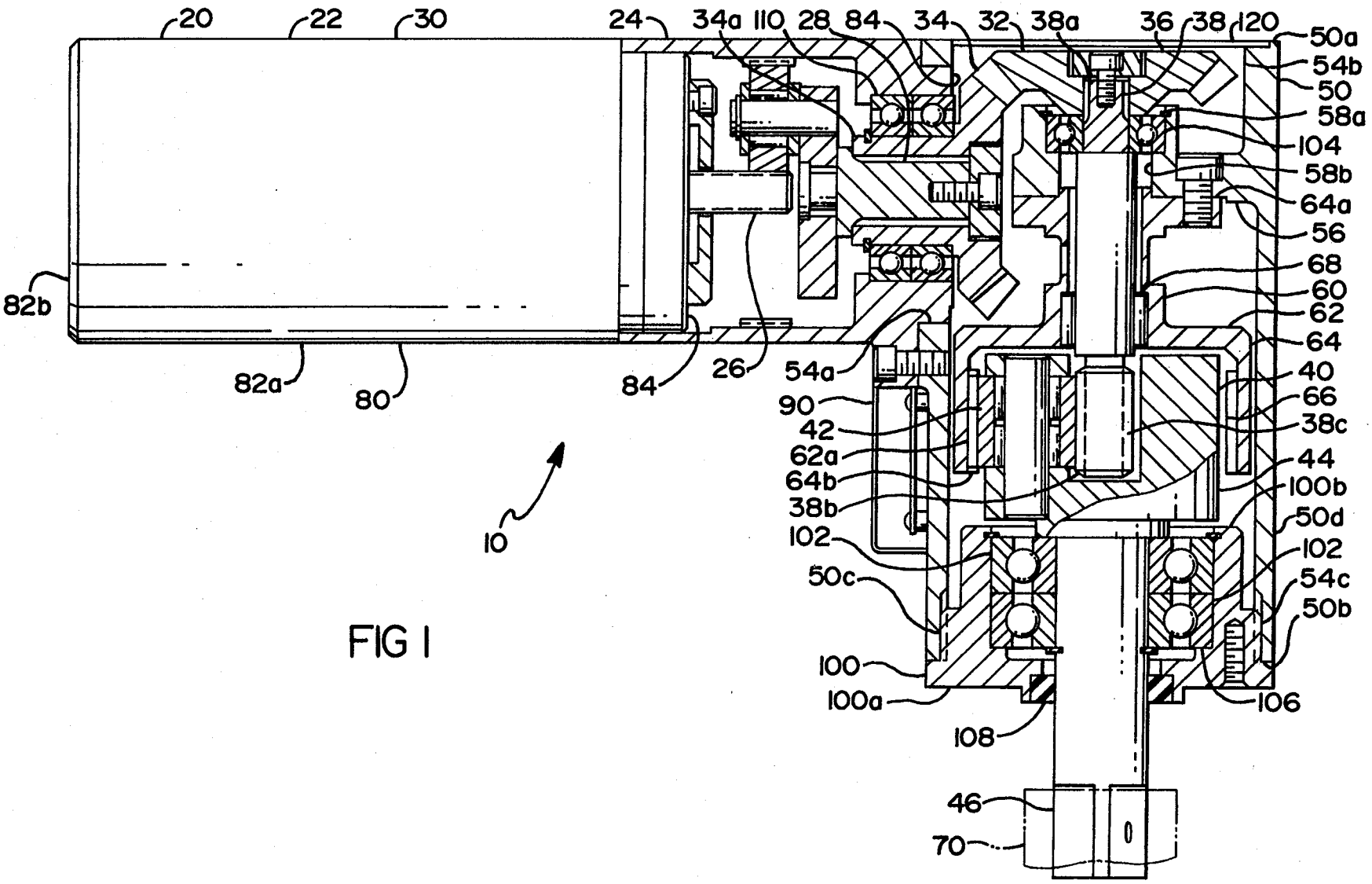
FIG. 1 is a side sectional view of the nut runner of the present invention.

Now with reference to the drawings, there is shown a nut runner for applying and measuring torque to a workpiece positioned at a right-angle to the nut runner and, generally, denoted at 10.

The fastening device or nut runner 10 hereof, generally, comprises:

(a) a body 30;

(b) means 20 for rotating a workpiece disposed within the body 30, the means 20 having a first output shaft 28 extending therefrom;

(b) a right-angle gear system 32, the gear system 32 being removably connected to the first shaft 28 of the means 20 for rotating, the gear system comprising:

(1) a first gear 34 removably attached to the first output shaft 28;

(2) a second gear 36 disposed normal to and meshing with the first gear 34;

(3) a second output shaft 38, the second shaft 38 disposed in-line with the second gear 36 and normal to the first output shaft 28, the second output shaft 38 having a first end **38*a* and a second end 38*b*, the second shaft 38 being removably connected to the second gear 36 proximate the first end 38*a*, the second shaft 38 having a plurality of gear teeth 38*c* proximate the second end 38*b*; and (4) a planetary gear system 40, the planetary gear system 40 connected to the second output shaft 38, the planetary gear system 40 cooperatively meshing with the gear teeth 38*c* of the second output shaft 38, the planetary gear system 40 having a third output shaft 46 in-line with the second output shaft 38 and normal to the first output shaft 28**;

(d) means 60 for sensing the torque being applied to the workpiece, the means 60 for sensing being disposed proximate the second end **38*b* of the second output shaft 38 immediate of the second gear 36, the means for sensing 60 surrounding the planetary gear system 40**;

(e) a gear housing 50, the gear housing 50 surrounding the right-angle gear system 32, means 60 for sensing and planetary gear system 40; and (f) a workpiece engaging member 70, the engaging member 70 being removably attached to the third output shaft 46.

Figure 2:
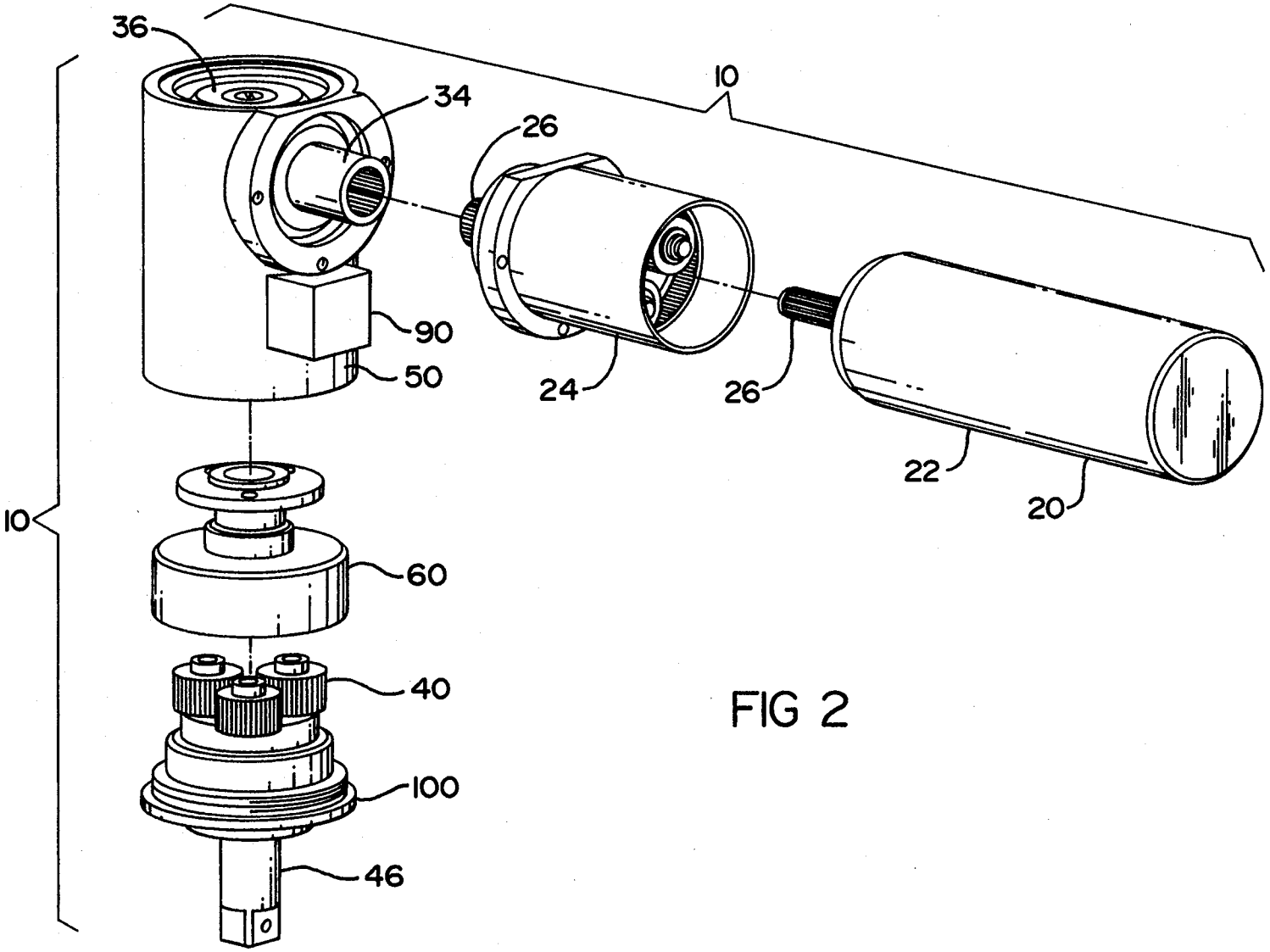
FIG. 2 is a partially exploded perspective view of the nut runner of the present invention.

In accordance herewith, and as shown in FIGS. 1 and 2, the means for rotating 20 includes a motor 22 operatively connected to a source of power (not shown). Although it is preferred to employ a D.C. or direct current electric motor herewith, other means such as an A.C. or alternating current electric motor, a fluid operated motor, an air operated motor or the like may alternately be employed.

A power shaft 26 is connected to the motor 22 and rotates in response thereto in a well known manner. The shaft 26 extends from the motor 22 to a speed reduction gear assembly or speed reducer 24.

The speed reducer 24 reduces the number of revolutions of the power shaft 26 of the motor 22 which would otherwise be imparted to the workpiece engaging member 70. Thus, the speed reducer 24 enables the workpiece engaging member 70 to rotate at a lower speed. Optimally, the speed reducer 24 comprises a planetary gear system of interlocking gears and a first output shaft 28 which extends from the speed reducer 24 to a right-angle gear system 32, as subsequently detailed. The first output shaft 28 rotates at a lower speed than the power shaft 26 of the motor 22.

As shown, the motor 22, the power shaft 26 and the speed reducer 24 are disposed within a housing 80. The housing 80 includes a side wall **82*a*, an end wall 82*b* and a mounting wall 84. The side wall 82*a* defines the stator for the motor 22**.

The right-angle gear system 32 functions to translate the rotation of the first output shaft 28 of the speed reducer 24 through a right-angle to a third output shaft 46 which holds the workpiece engaging member 70. The right-angle gear system 32 includes a first gear 34. The first gear 34 is in-line with and removably attached to the first output shaft 28 of the speed reducer 24 by set screws or the like. A second gear 36 operatively engages and meshes with the first gear 34 at a right-angle. The second gear 36 is removably attached to the second output shaft 38 extending therefrom at a right-angle to the first output shaft 28 of the speed reducer 24. The second output shaft 38 of the right-angle gear system 32 extends to and engages a planetary gear system 40. The rotating second output shaft 38 has a first end **38*a* and a second end 38*b*. The first end 38*a* of the second output shaft 38 removably attached to the second gear 36 by a screw or the like. The second end 38*b* of the second output shaft 38 has a plurality of gear teeth 38*c* formed thereon. The gear teeth 38*c* of the second end 38*b* of the second output shaft 38 cooperatively meshes with the planetary gear system 40**.

The planetary gear system 40 includes at least one planetary gear 42 which rotatably engages the gear teeth **38*c* of the second output shaft 38 extending from the right-angle gear system 32. The planetary gear 42 is rotatably attached to a third output shaft 46 which rotates the workpiece engaging member 70**, as detailed below.

The means 60 for sensing comprises, in the preferred embodiment, a torque transducer 62. The torque transducer 62 is an "in-line" transducer which measures the applied torque and is operatively connected to the bevel or right-angle gear system 32. In an "in-line" torque transducer, strain gages 68 are circumferentially disposed about the second output shaft 38 extending from the right-angle gear system 32. The strain gages 68 sense the strain produced by the applied torque of the second output shaft 38 in the well known manner. The sensed readings are sent from the transducer 62 to a controller (not shown) via a means 90 for transmitting.

The torque transducer 62 hereof comprises a substantially cylindrical housing 64 having first a mounting end 64*a* and second an open end 64*b*. The mounting end 64*a* mates with and is secured to the stationary flange 54 disposed within the gear housing 50. The open end 64*b* of the housing 50 is circumferentially disposed about the planetary gear system 40. An inner wall 62*a* of the transducer 62 proximate to the open end 64*b* has a plurality of gear teeth 66 formed thereon. The gear teeth 66 cooperatively mesh with the planetary gear 42 of the planetary gear system 40. The strain gage elements 68 of the transducer are disposed within the transducer 62 in any suitable fashion.

Alternatively, the torque transducer 60 may be a reaction torque transducer (not shown). The reaction torque transducer is operatively connected to the right-angle gear system 32 via the second output shaft 38. The reaction torque transducer comprises a substantially cylindrical housing with first and second mounting ends. The mounting ends are secured to a transducer and a stationary mounting surface, respectively, via suitable means, such as a threaded fastener or the like.

The interior of the housing for the reaction torque transducer has an enlarged diameter or "necked down" section. Beveled strain gage elements are circumferentially disposed about and are secured to the section in any suitable fashion. The strain gage elements sense the strain produced by the reaction torque which is being transmitted back to the housing. The stationary mounting surface provides a reference point for the gages.

The reaction torque transducer transmits the reaction torque which is equal to applied torque, but opposite in direction to the applied torque, back to the housing. The use of reaction torque transducers to sense applied torque is well known and such devices are commercially available.

The right-angle gear system 32, the means 60 for sensing and the planetary gear system 40 are covered by a gear housing 50. The gear housing 50 has a first end wall 50*a*, a second end wall 50*b*, a mounting wall 50*c* and a covering wall 50*d*. The gear housing 50 has a chamber 52 formed therein. Also, the gear housing 50 has apertures 54*a*, 54*b*, 54*c* formed within the housing walls 50*a*, 50*b* and 50*c* for assembly of the right-angle gear system 32, the means 60 for sensing and the planetary gear system. The first assembly aperture 54*a* is located in the mounting wall 50*c* proximate to the first end 50*a* of the housing 50. The second assembly aperture 54*b* is located at the first end 50*a* of the housing 50. The third assembly aperture 54*c* is located at the second end 50*b* of the housing 50. The elements of the gear system 32, the means 60 for sensing and the planetary gear system 40 are inserted through the respective apertures 54*a*, 54*b*, 54*c* of the housing 50 and assembled within the housing 50.

A mounting flange 56 is formed within the chamber 52 and extends from an inside wall 52*a* of the housing 50 proximate the first end 50*a*. The flange 56 has a first end 56*a* and a second end 56*b*. A partial bore 58, in axial alignment with the second output shaft 38 of the right-angle gear system 32, is formed in the first end 56*a* of the flange 56. The partial bore 58 is a seat for a first roller bearing system 104 which is disposed therein and supports the second gear 36 and the second output shaft 38. A smaller bore 58*b*, axially aligned with the second output shaft 38 and the partial bore 58, is formed therethrough to provide clearance for the second output shaft 38.

A first housing cover 100 is used to enclose the aperture 54*c* at the second end 50*b* of the housing 50. The cover 100 is removably attached to the second end 50*b* of the housing. The cover has a first end 100*a* and a second end 100*b*. A seating bore 102, in axial alignment with the third output shaft 46, is partially formed in the second end 100*b* of the cover 100 to seat a second roller bearing system 106 which is disposed therein. A smaller bore 104, in axial alignment with the third output shaft 46, is formed therethrough as a clearance hole for the third output shaft 46. A second housing cover 102 is used to enclose the aperture 54*b* at the first end 50*a* of the housing 50. The second housing cover 102 is a removably attached to the housing 50 by screws or the like.

The means 90 for transmitting the applied torque sensed by the torque transducer 62 is mounted on the mounting wall 50*c* of the housing 50 for the gear assembly 30 intermediate the first end 50*a* and the second end 50*b* of the housing 50. Such means 90 for transmitting are well known and commercially available. The means 90 for transmitting transmit the torque sensing signal from the torque transducer 62 to a control device (not shown) which controls the power supply to the nut runner.

As shown in the drawings, the first roller bearing system 104 seated in the partial bore 58*a* of the flange 56 urges against the second gear 36 and surrounds the second output shaft 38 to permit rotation thereof. The second roller bearing system 106, seated in the partial bore 102*a* of the cover 100, surrounds the third output shaft 46 to permit rotation thereof. An oil seal bearing 108 is seated within the first end 100*a* of the cover 100 and surrounds the third output shaft 46. The oil seal bearing 108 prevents leakage of oil from the chamber 52 of the housing 50.

The third roller bearing system 110 is seated within the housing 80 of the speed reducer 24 of the means 20 for rotating. The roller bearing system 110 surrounds the hub 34*a* of the first gear 34 to permit rotation.

The workpiece engaging member 70 is operatively attached to the third output shaft 46 of the planetary gear system 40. The engaging member 70 engages and rotates the workpiece or fastener.

In use, power is supplied to the motor 22 from an outside source (not shown). This causes the motor 22 to rotate the power shaft 26, rotating the speed reducer 24 which reduces the number of rotations between the power shaft 26 of the motor 22 and the first output shaft 28 of the speed reducer 24. The first output shaft 28 of the speed reducer 24 rotates the first right-angle gear 34 of the gear system 32. The first gear 34 meshes with the second gear 36, positioned normal to the first gear 34. This causes the second gear 36 to rotate at a right angle.

The torque translating from the first gear 34 to the second gear 36 is substantially reduced. The second gear 36 rotates the second output shaft 38 attached thereto. The second output shaft 38 extends through the torque transducer 62 to the planetary gear system 40, interacts with the torque transducer 62 and engages the planetary gear 42.

The second output shaft 38 urges against the sensors of the torque transducer and rotates the planetary gears 42 causing them to move within gear teeth 66 of the torque transducer 62. The movement of the planetary gears 42 causes the third output shaft 46 of the planetary gear system 40 to rotate. The third output shaft 46 rotates the workpiece engaging member 70 thereby applying torque to the workpiece.

The torque transducer 62 senses the torque applied by the second output shaft 38 extending from the second gear 36. This reading is sent to the controller (not shown) of the power supply to the nut runner 10. When the torque reaches the predetermined value, the controller terminates the power supply to the device 10 and the rotation stops.

Alternatively, the torque reading may be provided to the operator of the nut runner 10. The operator may manually interrupt the power supply to the nut runner 10, thereby stopping the rotation.

It is to be appreciated that there has been described herein a right-angle fastening device or nut runner which provides for a more accurate torque reading at a workpiece by positioning a means for sensing the torque in-line with and near the rotating workpiece engaging member. This assures that the fastener is properly tightened initially and reduces rework. The nut runner also provides for a compact profile by incorporating within the profile of the torque transducer the strain gauges; a portion of the second output shaft driving the planetary gears; and the planetary gears and a portion of the third output shaft attached to the planetary gears. This nesting type of assembly substantially reduces the size of the space occupied by the gears, shafts, etc. that is encountered with the traditional stacking assembly. The compact profile permits greater access to confined assembly areas and results in a lighter nut runner.

Having, thus, described the invention, what is claimed is:

1. A nut runner for applying a predetermined torque to a workpiece positioned at a right-angle to the nut runner, comprising:

(a) a body;

(b) means for rotating a workpiece disposed in the body, the means for rotating having a first output shaft extending therefrom;

(c) a right-angle gear system, the gear system removably connected to the first output shaft, the gear system comprising:

(1) a first gear removably attached to the first shaft;

(2) a second gear disposed normal to and meshing with the first gear;

(3) a second output shaft, the second output shaft connected to the second gear and normal to the first output shaft, the second shaft having a first end and a second end, the shaft being removably connected to the second gear 36 proximate the first end, the shaft having a plurality of gear teeth proximate the second end; and (4) a planetary gear system, the planetary gear system connected to the second output shaft, the planetary gear system cooperatively meshing with the gear teeth of the second shaft, the planetary gear system having a third output shaft extending therefrom in-line with the second output shaft and normal to the first output shaft;

(c) means for sensing the torque being applied to a workpiece, the means for sensing being disposed proximate the second end of the second output shaft immediate the second gear, the means for sensing surrounding the planetary gear system;

(d) a housing surrounding the right-angle gear system, the means for sensing and the planetary gear system; and (e) a workpiece engaging member, the engaging member being removably attached to the third output shaft.

2. The nut runner of claim 1, wherein the means for sensing comprises:

a torque transducer, the torque transducer being attached to the housing at one end thereof and surrounding the planetary gear system at a second end thereof.

3. The nut runner of claim 2 wherein the torque transducer is an in-line torque transducer.

4. The nut runner of claim 1 wherein the means for rotating comprises:

(a) a motor disposed in the body, the motor having a rotor;

(b) a power shaft operatively connected to the motor;

(c) a speed reduction gear assembly, the first output shaft being connected to the reduction gear assembly, the first output shaft extending from the reduction gear assembly to the right-angle gear assembly; and and wherein the body defines a stator, the body enclosing the motor and the speed reduction gear assembly.

5. The nut runner of claim 1, wherein the housing comprises:

(a) a first end and a second end;

(b) a mounting wall, a covering wall and an inner wall, the inner wall of the housing forming a chamber therein, the mounting wall having a first assembly aperture formed therein proximate to the first end, the covering wall having a second assembly aperture formed in the first end and a third assembly aperture formed in the second end;

(c) a support flange, the support flange formed within the chamber, the flange integrated with and extending from the inner wall of the housing proximate the first end; and wherein the housing defines an enclosure for the bevel gear system, the planetary gear system and the means for sensing.

6. The nut runner of claim 1 wherein the means for sensing torque comprises:

an in-line torque transducer, the torque transducer having a mounting end and an open end, the torque transducer surrounding the second output shaft of the right-angle gear system and the planetary gear and the hub end of the third output shaft of the planetary gear system, the mounting end of the torque transducer stationally mounted to the mounting flange of the housing; and wherein the second output shaft of the right-angle gear system extends from the second gear thereof, through the transducer and engages the planetary gear of the planetary gear system defining the means for sensing torque.

7. The nut runner of claim 5, wherein the housing further comprises:

a cover, the cover having a first end and a second end, the cover having an axially in-line roller bearing system disposed therein proximate the second end and an axially in line oil seal bearing disposed proximate the first end, and further wherein the bearings define a guide for the third output shaft extending from the planetary gear system.

8. The nut runner of claim 6, wherein the means for sensing torque further comprises:

means for transmitting torque readings from the torque transducer to a power supply controller and wherein, the power supply controller interrupts the power supply to the nut runner when the torque reading reaches a predetermined value.

9. The nut runner of claim 6 wherein the means for sensing torque further comprises:

means for transmitting torque readings from the torque transducer to an operator and wherein the operator interrupts the power supply to the nut runner when the torque reading reaches a predetermined value.

* * * * *